United States Patent [19]

Burns, Jr.

[11] 4,150,193

[45] Apr. 17, 1979

[54] INSULATED ELECTRICAL CONDUCTORS

[75] Inventor: Norman M. Burns, Jr., Somerset, N.J.

[73] Assignee: Union Carbide Corporation, New York, N.Y.

[21] Appl. No.: 862,127

[22] Filed: Dec. 19, 1977

[51] Int. Cl.[2] ..... H01B 1/06

[52] U.S. Cl. ..... 428/517; 252/511; 428/383; 174/102 SC; 174/105 SC; 174/120 SC

[58] Field of Search ..... 252/511; 174/102 SC, 174/105 SC, 120 SC; 428/517, 383

[56] References Cited

U.S. PATENT DOCUMENTS

| | | | |
|---|---|---|---|
| 2,953,541 | 9/1960 | Pecha et al. | 260/45.5 |
| 3,178,384 | 4/1965 | Rice et al. | 252/511 X |
| 3,424,631 | 1/1969 | Peacock | 156/51 |
| 3,629,154 | 12/1971 | Johnson | 252/511 |
| 3,684,821 | 8/1972 | Miyauchi et al. | 174/102 SC |
| 3,769,085 | 10/1973 | Matsubara | 174/120 SC X |
| 4,066,576 | 1/1978 | Bork et al. | 252/511 |

FOREIGN PATENT DOCUMENTS 716141 8/1965 Canada.

*Primary Examiner*—Benjamin R. Padgett
*Assistant Examiner*—E. Suzanne Parr
*Attorney, Agent, or Firm*—Reynold J. Finnegan

[57] ABSTRACT

Vulcanizable semi-conducting compositions that can be used to provide strippable insulation shielding compositions for electrical conductors, and articles of manufacture wherein the crosslinked product of said vulcanizable compositions are directly bonded to a crosslinked polyolefin substrate.

23 Claims, No Drawings

INSULATED ELECTRICAL CONDUCTORS

BACKGROUND OF THE INVENTION

This invention relates to vulcanizable semi-conductive compositions which provide strippable semi-conductive insulation shielding compositions for insulated electrical conductors.

The construction of insulated electrical conductors, i.e., wires and cable, designed for medium to high voltage applications is well known in the art and commonly comprises a core conductor which comprises one or more strands or a conducting metal or alloy such as copper or aluminum, a layer of semi-conductive shielding, a layer of insulation, such as cross-linked polyethylene, and a layer of semi-conductive insulation shielding overlying said insulation. A plurality of neutral wires which are usually made of copper or aluminum may be embedded in or wrapped around the layer of semi-conducting insulation shielding, if desired, in the form of a concentric ring around the insulated cable.

The insulation layer and its overlying semi-conductive shielding layer can be formed in the art by what is known as a two pass operation or by a single pass triple extrusion process. The two pass operation is one in which the insulation is first extruded and crosslinked prior to extrusion and crosslinking of the semi-conductive insulation shielding layer. In the single pass triple extrusion operation (sometimes called a tandem extrusion when referring only to the insulation layer and its semi-conductive shielding layer) the semi-conductive conductor shielding layer, the insulation layer, and the overlying semi-conductive insulation shielding layer are extruded in sequence and cured (crosslinked) simultaneously in a single operation to minimize manufacturing steps. For obvious reasons the single pass triple extrusion method is preferred by manufacturers. However, the sumultaneous curing of the insulation layer and its overlying semi-conductive shielding layer of the triple extrusion method in general makes the shielding layer more fully bonded in most cases to the insulation that it might be if it were made as a result of a two pass operation.

The formation of the bond between the insulation and insulation shielding layer makes subsequent separation of the two layers (insulation and semi-conductive shielding) such as occurs in making splices or terminal connections, very difficult and time consuming. Such a strong bond also makes the semi-conductive layer prone to leave carbon residue on the insulation even when it is finally peeled off. Accordingly, a strippable semi-conductive shielding which can be easily and cleanly stripped from the insulation of an insulated conductor that has been made by a single pass triple extrusion operation is therefore very desirable in this art.

It has now been discovered that such types of easily strippable semi-conducting insulation shielding compositions can be prepared from the vulcanizable semi-conductive insulation shielding compositions of this invention which contain both an ethylene-vinyl acetate copolymer and polyethylene homopolymer as described more fully below, the cured insulation shieldings of which have been found to be more easily strippable from the cured insulation than that of corresponding cured insulation shieldings obtained from vulcanizable ethylene-vinyl acetate copolymer compositions free of polyethylene homopolymer even when both the insulation and insulation shielding layers are cured simultaneously in one operation.

Thus, it is an object of this invention to provide a vulcanizable semi-conductive insulation shielding composition which is particularly useful for providing a strippable shielding for insulated electrical conductors, e.g., wires and cables, that contain, as the primary insulation, a crosslinked polyolefin. Another object of this invention is to provide an article of manufacture comprising the crosslinked product of said vulcanizable semi-conductive insulation shielding composition of this invention bonded directly to a crosslinked polyolefin substrate. Yet another object of this invention is to provide an article of manufacture as defined above wherein said crosslinked polyethylene is the primary insulation of an insulated electrical conductor, thus providing insulated electrical conductors, e.g., wires and cables, comprising, as the primary insulation, a crosslinked polyolefin, and as the shielding for said insulation an easily strippable crosslinked semi-conductive shielding composition. Other objects and advantages of this invention will become readily apparent from the following description and appended claims.

More specifically, the instant invention may be described as a strippable vulcanizable semi-conductive insulation shielding composition consisting essentially of, based on the total weight of said composition, (A) about 40 to about 90 weight percent of an ethylene-vinyl acetate copolymer containing from about 27 to 45 weight percent of vinyl acetate based on the total weight of said copolymer, (B) about 3 to about 15 weight percent of a low density, low molecular weight polyethylene homopolymer, (C) about 8 to about 45 weight percent of carbon black, and (D) about 0.2 to about 5 weight percent of an organic peroxide crosslinking agent.

DESCRIPTION OF THE PREFERRED EMBODIMENTS

The vulcanizable ethylene-vinyl acetate copolymers and/or their method of preparation, which can be employed in this invention are well known in the art. The ethylene-vinyl acetate copolymer employed herein should contain from 27 to 45 weight percent of vinyl acetate based on the total weight of said copolymer for it is considered that copolymers containing less than 27 weight percent vinyl acetate may lead to semi-conductive insulation shieldings having poorer strippability; while copolymers having more than 45 weight percent of vinyl acetate may be too difficult to compound due to their low melting points. The amount of ethylene-vinyl acetate copolymer present in the vulcanizable semi-conductive insulation shielding compositions of this invention can range from about 40 to about 90 weight percent based on the total weight of the vulcanizable composition. Of course it is understood that while it is generally preferred to employ only one type of ethylene-vinyl acetate copolymer in a given composition, the vulcanizable compositions of this invention also include and encompass the use of mixtures of two or more ethylene-vinyl acetate copolymers having different amounts of vinyl acetate.

The low density, low molecular weight, polyethylene homopolymers which can be employed in this invention have number average molecular weights of from about 2,000 to about 10,000, densities of about 0.85 up to about 0.93 grams per cubic centimeter and a melt index of 20 to 500 when measured according to ASTM-D-1238 at 125° C. Such polyethylene homopolymers as well as methods for their preparation are well known in the art and are highly branched polyethylenes which can conveniently be obtained by conventional high pressure, high temperature polymerization processes, as seen disclosed, for example, in U.S. Pat. Nos. 2,188,465 and 3,183,283. The literature is replete with references describing such processes which will produce such polyethylene homopolymers, and the particular manner of preparation of these homopolymers is immaterial for the purpose of this invention. The amount of polyethylene homopolymer present in the vulcanizable semi-conductive insulation shielding compositions of this invention can range from about 3 to 15 weight percent, preferably from about 5 to 10 weight percent, based on the total weight of the vulcanizable composition. Of course it is understood that while it is generally preferred to employ one type of polyethylene homopolymer in a given composition, the vulcanizable compositions of this invention also include and encompass the use of mixtures of two or more polyethylene homopolymers having different average molecular weights and/or different densities.

The employment of carbon black in semi-conductive insulation shielding compositions is well known in the art and any carbon black in any suitable form, as well as mixtures thereof, can be employed in this invention, including channel blacks or acetylene blacks. The amount of carbon black present in the vulcanizable semi-conductive insulation shielding compositions of this invention can range from about 8 to about 45 weight percent, based on the total weight of the vulcanizable composition.

Any organic peroxide crosslinking agent used in heretofore conventional semi-conductive compositions can be employed in this invention. Illustrative examples of such peroxide crosslinking agents include e.g., di-$\alpha$-cumyl peroxide, $\alpha,\alpha'$bis(tertiary-butylperoxy) diisopropylbenzene, 2,5-dimethyl-2',5'-di(tertiary-butylperoxy)-hexane, 2,5-dimethyl-2',5'-di(tertiary-butylperoxy)-hexyne-3, and the like, as well as mixtures thereof. While the preferred amount of crosslinking agent employed herein may vary depending upon the particular copolymer employed and other such obvious conditions as processing factors, in general it is considered that said amount of crosslinking agent will normally fall within the range of about 0.2 to 5, preferably about 0.6 to 2, weight percent based on the total weight of the vulcanizable semi-conductive composition.

Of course it is understood that the vulcanizable semi-conductive insulation shielding compositions of this invention can be prepared in any conventional manner and, if desired, can contain other conventional additives in the conventional used quantities commonly employed in semi-conductive compositions. Examples of such additives include e.g. age resistors, processing aids, stabilizers, antioxidants, crosslinking boosters and retarders, pigments, fillers, lubricants, ultraviolet stabilizers, antiblock agents and the like. The total amount of such additives which are commonly used normally amounts to no more than about 0.05 to 3 percent by weight based on the total weight of the insulation shielding composition. For instance, it is generally preferred to employ about 0.2 to about 1 percent by weight based on the total weight of the insulation shielding composition of an antioxidant such as polymerized 1,2-dihydro-2,2,4-trimethylquinoline.

Whether or not a particular vulcanizable composition will furnish a crosslinked polyolefin insulated electrical conductor with an easily strippable semi-conductive insulation shielding, said conductor being manufactured via a single pass triple extrusion operation, may be generally determined by measuring the adhesion between a simultaneously cured laminate of crosslinked polyolefin and the crosslinked product of the vulcanizable semi-conductive composition according to ASTM-D903. While the actual adhesion levels of such layers on a conductor may be higher than that obtained for the corresponding laminate, the above test serves as a useful guideline for predetermining such results. Thus, in order to be considered an easily strippable insulation shielding composition the simultaneously cured laminate adhesion level of the crosslinked product of the semi-conductive composition for the crosslinked polyolefin should not be more than 15 pounds per half inch strip when measured according to said test method.

As pointed out above, another aspect of this invention may be described as an article of manufacture comprising the crosslinked product of the vulcanizable semi-conductive shielding composition of this invention defined above bonded directly to a crosslinked polyolefin substrate. Said article of manufacture may take any shape or form desired, e.g., it could be a laminated plaque or sheet, which is obviously useful in determining whether or not said crosslinked product would be useful as an easily strippable insulation shielding for an electrical conductor as explained above.

More preferably, the crosslinked polyolefin of said article of manufacture of this invention is the primary insulation of an insulated electrical conductor, the crosslinked product of said vulcanizable composition being the external semi-conductive shielding for said insulation. Accordingly, the preferred article of manufacture of this invention may be more specifically described as an insulated electrical conductor, e.g., electrical wire, electrical cable, etc., containing as the primary insulation, crosslinked polyolefin and as the external semi-conductive shielding for said insulation, the crosslinked product obtained upon cross-linking the vulcanizable semi-conductive insulation shielding composition of this invention which has been already previously defined above.

Of course, it is to be understood that the term "crosslinked polyolefin" as used herein includes and encompasses compositions derived from a crosslinkable polyethylene homopolymer or a crosslinkable polyethylene copolymer such as ethylene-propylene rubber or ethylene-propylene-diene rubber insulations for electrical conductors. Normally, the preferred crosslinked polyolefin insulation is derived from a crosslinkable polyethylene homopolymer. It is to be further understood that said crosslinkable polyolefins used to form the crosslinked polyolefin substrates (e.g., primary insulation layer) can have number average molecular weights of at least about 15,000 up to about 40,000 or higher and a melt index of about 0.2 to about 20 when measured according to ASTM D-1238 at 190° C. and thus are not the same nor should they be confused with the low density, low molecular weight polyethylene homopolymer additives of the vulcanizable ethylene-vinyl acetate compositions of this invention.

The use of articles of manufacture containing a crosslinked shielding directly bonded to a crosslinked polyolefin substrate and the manner of their preparation are so well known that no further discussion is required to enable one skilled in the art to understand how to produce and use said articles. For instance, the vulcanizable semi-conductive shielding composition can be extruded over a crosslinked polyolefin substrate and cured (crosslinked) thereon. More preferably it is extruded over an uncrosslinked polyolefin substrate and both crosslinkable layers simultaneously cured. Likewise the use of polyethylene insulation compositions which if desired, may contain conventional additives such as fillers, age resistors, talc, clay, calcium carbonate and other processing aides, along with a conventional crosslinking agent is well known in the art as are conventional semi-conducting conductor shielding compositions. The insulated electrical conductors of this invention are preferably prepared by the conventional single pass triple extrusion procedure involving simultaneously curing (crosslinking) of both the insulation and insulation shielding layer. However, if desired the conventional method of curing the insulation layer prior to contact with the vulcanizable semi-conductive insulation shielding composition can also be employed. In general, it is considered desirable to prevent any premixing of the insulation composition and vulcanizable semi-conductive insulation shielding composition prior to curing said compositions since such may allow the crosslinking agents employed to assert their influence on adhesion between the two layers through intercrosslinking across the interface of the two layers. The other particular attributes of the articles of manufacture of this invention e.g. insulated electrical conductors may also conform to the conventional structure of such articles and are not critical for they depend for the most part merely upon the desired end use of such articles.

The following examples are illustrative of the present invention and are not to be regarded as limitative. It is to be understood that all parts, percentages and proportions referred to herein and in the appended claims are by weight unless otherwise indicated.

EXAMPLES 1-3

Three vulcanizable semi-conductive compositions containing the following ingredients were prepared, the amounts of all the ingredients in each composition being based on the total weight of each composition.

TABLE I

| Vulcanizable Composition | Example 1 (wt. %) | Example 2 (wt. %) | Example 3 (wt. %) |
|---|---|---|---|
| EVA* | 61.9 | 56.9 | 54.9 |
| Polyethylene Homopolymer** | — | 5.0 | 7.0 |
| Carbon Black*** | 37.0 | 37.0 | 37.0 |
| Antioxidant+ | 0.5 | 0.5 | 0.5 |
| Organic Peroxide++ | 0.6 | 0.6 | 0.6 |

*Ethylene (about 72 wt. %)/Vinyl Acetate (about 28 wt. %) Copolymer; Melt Index about 20

**Density of about 0.88 g/cm$^3$; 98° C. Melting Point; Acid Number-Nil; Viscosity at 130° C. about 520; Melt Index 80 to 360 (ASTM D-1238 at 125° C.) and Number Average Molecular Weight of about 4000.

***ASTM N-351Grade

+ Polymerized 1,2-dihydro-2,2,4-trimethylquinoline

++ α,60 '-bis-(tertiary-butylperoxy)diisopropylbenzene(Vulcup)

Each composition was formed in the same manner by uniformly admixing the components thereof in a laboratory batch intensive mixer. After charging the ingredients, the mixer rotors were run with the ram down until fluxing occurred. At this point the ram was raised to turn the batch. The ram was then lowered again and the mixing completed and the batch removed when the temperature reached 110° C.

In order to evaluate the strippability properties of these compositions as semi-conducting insulation shieldings, each composition was respectively used to prepare a polyethylene/ethylene-vinyl acetate laminate. Said laminates were prepared from laboratory test plaques, the polyethylene plaque in each instance was derived from a crosslinkable polyethylene homopolymer composition consisting of polyethylene homopolymer (98%) having number average molecular weight about 25,000 to 30,000 and a melt index of about 2, (ASTM-D-1238 at 190° C), di-α-cumyl peroxide (2%) and bis(2-methyl,5-tertiary butyl-4-hydroxyphenyl) sulfide (0.2%) as an anti-oxidant; the ethylene-vinyl acetate plaques being derived from the vulcanizable compositions of Examples 1 to 3 above.

The polyethylene/ethylene-vinyl acetate laminates were made by first molding the crosslinkable polyethylene plaques (measuring 8" by 8" and 75 mils thick) at 115° C. for 5 minutes to prepare uncrosslinked plaques. Then the uncured vulcanizable ethylene-vinyl acetate plaques (measuring 8" by 8" and 75 miles thick) were separately molded at 115° C. for 5 minutes. The laminates were then made by pressing each vulcanizable ethylene-vinyl acetate plaque together with one of the uncrosslinked polyethylene plaques at 180° C. and 700 psi ram pressure for 20 minutes during which time both laminate layers were simultaneously crosslinked. This procedure is intended to simulate the extrusion and crosslinking of cable manufactured by the triple extrusion process.

After cooling, the adhesion between the laminates was tested according to ASTM Test Method D-903 by measuring the force required to peel the semi-conductive ethylene-vinylacetate layer from the polyethylene insulation on 5" by ½" strips punched from the test laminates. Testing was done on an Instron tensile tester by clamping each end of the laminate (which had been previously peeled back) in the jaws of the machine, and recording the force in pounds necessary to peel or strip the semi-conductive ethylene-vinyl acetate layer from the polyethylene insulation at an angle of 90°. The test results for each laminate (said results representing the average value for testing at least five such laminates for each vulcanizable semi-conductive composition are given in TABLE II below.

TABLE II

| Example | Laminate Adhesion (lbs/half inch strip) |
|---|---|
| Example 1 | 11.4 |
| Example 2 | 10.0 |
| Example 3 | 9.5 |

While the crosslinked semi-conductive ethylene-vinyl acetate shielding layer was stripped clean from the crosslinked polyethylene insulation in each of Examples 1 to 3, the above results show that the addition of low density, low molecular weight polyethylene homopolymer to the semi-conductive ethylene-vinyl acetate composition substantially reduced the adhesion to crosslinked polyethylene insulation by as much as 15 to 20% when the semi-conductive composition and polyethylene are simultaneously covulcanized in a laminate form.

EXAMPLE 4

The vulcanizable semi-conductive composition of Example 3 above was used to prepare an insulated electrical cable in the following manner.

A standard aluminum conductor was sequentially covered with an ordinary semi-conductive strand shielding layer (0.025" thick); an insulation layer (0.260" thick) derived from a crosslinkable polyethylene homopolymer (98%) having a number average molecular weight of about 25,000 to 30,000 and a melt index of about 2, (ASTM D-1238 at 190° C.), di-α-cumyl peroxide (2%) and bis(2-methyl,5-tertiary butyl-4-hydroxyphenyl)sulfide (0.2%) as an anti-oxidant; and a semi-conductive insulation shielding layer (0.055" thick) derived from the vulcanizable ethylene-vinyl acetate and low density, low molecular weight polyethylene homopolymer containing composition of Example 3 above.

In preparing the cable, all three layers of strand shielding, insulation and insulation shielding were extruded sequentially and simultaneously cured in a steam vulcanization tube (250 lbs./sq. in. of steam). This process precedure is conventionally known in the art as a single pass triple extrusion.

The adhesion of the insulation shielding to the insulation of the insulated cable was determined by the same method described in Examples 1 to 3 above. The insulation shielding was stripped clean and in one piece from the insulation and exhibited an adhesion level of 14 to 20 pounds per half-inch strip, this demonstrating the excellent strippability of the insulation shielding composition of this invention.

A comparative insulated electrical cable was prepared and tested in the same manner using the insulation shielding composition of Example 1 above which does not contain any low density, low molecular weight polyethylene homopolymer. The insulation layer was stripped clean and in one piece, but exhibited an adhesion level of 25 to 30 pounds per half-inch strip.

Various modifications and variations of this invention will be obvious to a worker skilled in the art and it is to be understood that such modifications and variations are to be included within the purview of this application and the spirit and scope of the appended claims.

What is claimed is:

1. A vulcanizable semi-conductive insulation shielding composition consisting essentially of, based on the total weight of said composition, (A) about 40 to 90 weight percent of an ethylene-vinyl acetate copolymer containing from about 27 to 45 weight percent of vinyl acetate based on the total weight of said copolymer, (B) about 3 to about 15 weight percent of a low density low molecular weight polyethylene homopolymer having a number average molecular weight of about 2,000 to about 10,000, a density of about 0.85 up to about 0.93 grams per cubic centimeter and a melt index of 20 to 500 when measured according to ASTM D-1238 at 125° C., (C) about 8 to about 45 weight percent of carbon black, and (D) about 0.2 to about 5 weight percent of an organic peroxide crosslinking agent.

2. A vulcanizable composition as defined in claim 1, wherein the polyethylene homopolymer is present in an amount of about 5 to about 10 percent by weight based on the total weight of the composition.

3. A vulcanizable composition as defined in claim 1, wherein about 0.2 to about 1 percent by weight of an antioxidant based on the total weight of the composition is also present.

4. A vulcanizable composition as defined in claim 3, wherein said ethylene-vinyl acetate copolymer contains about 28 weight percent of vinyl acetate based upon the total weight of said copolymer.

5. A vulcanizable composition as defined in claim 4, wherein the polyethylene homopolymer has a density of about 0.88 g/cm$^3$, a number average molecular weight of about 4000 and a melt index of 80 to 360 when measured according to ASTM D-1238 at 125° C.

6. A vulcanizable composition as defined in claim 5, wherein the polyethylene homopolymer is present in an amount of about 5 to about 10 percent by weight based on the total weight of the composition.

7. A vulcanizable composition as defined in claim 1, wherein the organic peroxide is present in an amount of from 0.6 to about 2 percent by weight based on the total weight of the composition.

8. An article of manufacture comprising the crosslinked product of a vulcanizable semi-conductive composition as defined in claim 1, said crosslinked product being directly bonded to a crosslinked polyolefin substrate, said crosslinked polyolefin having been derived from a polyolefin having a number average molecular weight of at least 15,000 and a melt index of about 0.2 to about 20 when measured according to ASTM D-1238 at 190° C.

9. A article of manufacture as defined in claim 8, wherein said polyolefin is a polyethylene homopolymer.

10. An article of manufacture comprising the crosslinked product of a vulcanizable semi-conductive composition as defined in claim 2, said crosslinked product being directly bonded to a crosslinked polyethylene substrate, said crosslinked polyethylene having been derived from a polyethylene homopolymer having a number average molecular weight of at least about 15,000 and a melt index of about 0.2 to about 20 when measured according to ASTM D-1238 at 190° C.

11. An article of manufacture comprising the crosslinked product of a vulcanizable semi-conductive composition as defined in claim 3, said crosslinked product being directly bonded to a crosslinked polyethylene substrate, said crosslinked polyethylene having been derived from a polyethylene homopolymer having a number average molecular weight of at least about 15,000 and a melt index of about 0.2 to about 20 when measured according to ASTM D-1238 at 190° C.

12. An article of manufacture comprising the crosslinked product of a vulcanizable semi-conductive composition as defined in claim 4, said crosslinked product being directly bonded to a crosslinked polyethylene substrate, said crosslinked polyethylene having been derived from a polyethylene homopolymer having a number average molecular weight of at least about 15,000 and a melt index of about 0.2 to about 20 when measured according to ASTM D-1238 at 190° C.

13. An article of manufacture comprising the crosslinked product of a vulcanizable semi-conductive composition as defined in claim 5, said crosslinked product being directly bonded to a crosslinked polyethylene substrate, said crosslinked polyethylene having been derived from a polyethylene homopolymer having a number average molecular weight of at least about 15,000 and a melt index of about 0.2 to about 20 when measured according to ASTM D-1238 at 190° C.

14. An article of manufacture comprising the crosslinked product of a vulcanizable semi-conductive composition as defined in claim 6, said crosslinked product being directly bonded to a crosslinked polyethylene substrate, said crosslinked polyethylene having been derived from a polyethylene homopolymer having a number average molecular weight of at least about 15,000 and a melt index of about 0.2 to about 20 when measured according to ASTM D-1238 at 190° C.

15. An article of manufacture comprising the crosslinked product of a vulcanizable semi-conductive composition as defined in claim 7, said crosslinked product being directly bonded to a crosslinked polyethylene substrate, said crosslinked polyethylene having been derived from a polyethylene homopolymer having a number average molecular weight of at least about 15,000 and a melt index of about 0.2 to about 20 when measured according to ASTM D-1238 at 190° C.

16. An article of manufacture as defined in claim 8, wherein said crosslinked polyolefin substrate is the primary insulation of an electrical conductor and said crosslinked product is the external semi-conductive shielding for said insulation.

17. An article of manufacture as defined in claim 9, wherein said crosslinked polyolefin substrate is the primary insulation of an electrical conductor and said crosslinked product is the external semi-conductive shielding for said insulation.

18. An article of manufacture as defined in claim 10, wherein said crosslinked polyethylene substrate is the primary insulation of an electrical conductor and said crosslinked product is the external semi-conductive shielding for said insulation.

19. An article of manufacture as defined in claim 11, wherein said crosslinked polyethylene substrate is the primary insulation of an electrical conductor and said crosslinked product is the external semi-conductive shielding for said insulation.

20. An article of manufacture as defined in claim 12, wherein said crosslinked polyethylene substrate is the primary insulation of an electrical conductor and said crosslinked product is the external semi-conductive shielding for said insulation.

21. An article of manufacture as defined in claim 13, wherein said crosslinked polyethylene substrate is the primary insulation of an electrical conductor and said crosslinked product is the external semi-conductive shielding for said insulation.

22. An article of manufacture as defined in claim 14, wherein said crosslinked polyethylene substrate is the primary insulation of an electrical conductor and said crosslinked product is the external semi-conductive shielding for said insulation.

23. An article of manufacture as defined in claim 15, wherein said crosslinked polyethylene substrate is the primary insulation of an electrical conductor and said crosslinked product is the external semi-conductive shielding for said insulation.

* * * * *

UNITED STATES PATENT AND TRADEMARK OFFICE

CERTIFICATE OF CORRECTION

PATENT NO. : 4,150,193

DATED : April 17, 1979

INVENTOR(S) : Norman M. Burns, Jr.

It is certified that error appears in the above-identified patent and that said Letters Patent are hereby corrected as shown below:

In column 1, line 41, "that" should read -- than --.

In column 5, line 59, should read

-- ++α,α'-bis-(tertiary-butylperoxy)diisopropylbenzene (Vulcup) --.

In column 6, line 23, "miles" should read -- mils --.

Signed and Sealed this

*Eleventh* Day of *September 1979*

[SEAL]

*Attest:*

*Attesting Officer*

LUTRELLE F. PARKER

*Acting Commissioner of Patents and Trademarks*